US006554467B2

(12) United States Patent
Snyder et al.

(10) Patent No.: US 6,554,467 B2
(45) Date of Patent: Apr. 29, 2003

(54) PROCESS AND APPARATUS FOR BLENDING AND DISTRIBUTING A SLURRY SOLUTION

(75) Inventors: David L. Snyder, Princeton, TX (US); Karl J. Urquhart, McKinney, TX (US); Richard Swindell, Bonham, TX (US)

(73) Assignees: L'Air Liquide - Societe' Anonyme a'Directoire et Conseil de Surveillance pour l'etude et l'Exploitation des Procedes Georges Claude, Paris (FR); Air Liquide America, L.P., Houston, TX (US)

( * ) Notice: Subject to any disclaimer, the term of this patent is extended or adjusted under 35 U.S.C. 154(b) by 45 days.

(21) Appl. No.: 09/779,470

(22) Filed: Feb. 9, 2001

(65) Prior Publication Data

US 2002/0085447 A1 Jul. 4, 2002

Related U.S. Application Data

(63) Continuation-in-part of application No. 09/749,424, filed on Dec. 28, 2000.

(51) Int. Cl.[7] ..... B01F 15/02; B24B 57/02

(52) U.S. Cl. ..... 366/348; 366/136; 366/152.1; 366/141; 451/60; 451/88; 451/446

(58) Field of Search ..... 366/136, 138, 366/141, 152.1, 152.4, 152.6, 153.1, 348; 451/60, 88, 446, 36

(56) References Cited

U.S. PATENT DOCUMENTS

| | | | | |
|---|---|---|---|---|
| 5,340,210 A | * | 8/1994 | Patel et al. | 366/141 |
| 5,407,526 A | * | 4/1995 | Danielson et al. | |
| 5,478,435 A | * | 12/1995 | Murphy et al. | |
| 5,558,435 A | * | 9/1996 | Marjo | 366/141 |
| 5,755,614 A | * | 5/1998 | Adams et al. | 451/60 |
| 6,123,602 A | * | 9/2000 | Rodriguez et al. | 451/60 |
| 6,358,125 B2 | * | 3/2002 | Kawashima et al. | 451/60 |
| 6,404,364 B1 | * | 6/2002 | Kimura et al. | 451/446 |

* cited by examiner

*Primary Examiner*—Joseph W. Drodge
(74) *Attorney, Agent, or Firm*—Linda K. Russell

(57) ABSTRACT

On-site blending and distribution of oxide abrasives with other constituents as used in semiconductor applications. Constituent blending is accomplished through weighing components individually into a blending tank. Some components may be added by injection or weight. Alternatively blends can be made to varying concentrations by passing the blended oxide solution in a closed circulation loop through a calibrated encapsulated torroid coil to measure electrical conductivity. The resulting conductivity output may be used to add one or more component.

41 Claims, 4 Drawing Sheets

PROCESS AND APPARATUS FOR BLENDING AND DISTRIBUTING A SLURRY SOLUTION

CROSS REFERENCE TO RELATED APPLICATION

This application is a continuation-in-part of U.S. application Ser. No. 09/749,424, filed on Dec. 28, 2000, and is incorporated herein in its entirety.

BACKGROUND OF THE INVENTION

1. Field of the Invention

The present invention relates to a process for blending and distributing a slurry solution to a point of use in a semiconductor processing facility. The invention also relates to a system and process for producing and distributing suspensions and slurries, particularly abrasive slurries employed in the electronics industry.

2. Description of Related Art

In the semiconductor manufacturing industry, chemical mechanical polishing or planarization (CMP) is used to planarize the surface of a semiconductor substrate. Typically, the CMP process involves attaching a semiconductor wafer to a carrier via a mounting pad, and to polish the exposed surface of the wafer by bringing it into contact with a polishing pad. The mechanical abrasion between the wafer surface and the polishing pad results in planarization of the wafer surface.

To aid in the planarization of the wafer surface and to transport disengaged wafer particles from the wafer surface, a slurry is introduced between the wafer surface and the polishing pad. Slurries typically include abrasive particles and a medium in which the abrasive particles are suspended. In addition, oxidizing agents are often blended with the slurry either at the point of use or on-site as per customer specifications. Surfactants can also be added to the slurry to enhance the wettability of the surface being polished and reduce vibrations during planarization. The chemical components of the slurry react with the wafer surface, thereby making the wafer more easily polishable.

One common use of these techniques is the plug formation process. In this process, after depositing a dielectric layer on the semiconductor surface, contact holes are formed in the dielectric layer by photolithography and etching processes. A metal is then blanket deposited on the wafer to fill the holes and to form an overlying layer of the metal. The CMP process is next performed until the metal over the dielectric layer is removed, leaving metal plugs in the holes.

There are several problems associated with the mixing and handling of slurries. For example, while deionized water is generally available in semiconductor manufacturing environments, the other slurry components are generally hazardous chemicals which must be carefully handled, mixed and delivered to the process tool. In addition, these slurries are colloidal suspensions which must remain homogeneous after mixing and during distribution to the point of use. Further, typically slurries have a limited shelf life after being mixed.

Slurry delivery and mixing systems have been proposed in which the slurry is mixed on site at a manufacturing plant. An example of such a system is disclosed in U.S. Pat. No. 5,407,526 to Danielson et al, wherein a slurry concentrate and oxidant are pumped into a mixing chamber where they are mixed to form a slurry which is delivered to the processing tool. In this system, the mixing of slurry can occur only when the tool is in operation.

Another slurry mixing system is disclosed in U.S. Pat. No. 5,478,435 to Murphy et al, in which slurries are pumped directly onto a polishing pad of a chemical mechanical planarization tool. The slurry components are blended until a desired pH is obtained. However, upon delivery to the processing tool, the solution is not necessarily homogeneous or of the desired concentration for the particular application.

To meet the requirements of the semiconductor processing industry and to overcome the disadvantages of the related art, it is an object of the present invention to provide a novel, integrated system for onsite blending and distribution of an oxide abrasive slurry solution.

It is another object of the invention to provide the slurry solution constituents to a blending tank based on weight and/or optionally by injection, or together with the metering pump filling by weight.

It is a further object of the invention to monitor and adjust the concentration of the components forming the slurry solution.

It is another object of the invention to supply a homogeneous slurry solution to a number of processing tools regardless of whether they are in operation.

It is yet another object of the invention to continuously supply the processing tools while simultaneously formulating a subsequent slurry solution to be supplied to the process tank and therefrom to the processing tools.

It is another object of the invention to provide a facile manner of accessing different parts of the system to clean or repair them while minimizing down time.

Other objects and aspects of the present invention will become apparent to one of ordinary skill in the art upon review of the specification, drawings and claims appended hereto.

SUMMARY OF THE INVENTION

In accordance with the present invention, an innovative process and system for blending and distributing oxide abrasive slurry solutions is provided. The invention finds particular applicability in the semiconductor manufacturing industry, wherein chemical solutions of desired formulations can be generated on-site, with the resulting solution being introduced directly into one or more semiconductor processing tools for chemical mechanical polishing.

According to an aspect of the invention, a process for blending and distributing a slurry solution to a point of use is provided. The process includes supplying at least a first and a second component to a mix tank sequentially. Each component is added until a coarse weight set point is reached and, upon attaining said coarse point, the component is allowed to settle and further added via pulsed injection until a fine weight set point is attained. Thereafter, the components are blended into a slurry solution and conveyed to a process tank and henceforth to the point of use.

According to another aspect of the invention, a system for blending and distributing a slurry solution to a point of use in a semiconductor facility is provided. The system includes a mix tank wherein at least a first and second component are added sequentially until each component reaches a coarse weight set point. The component is allowed to settle and further added via pulsed injection until a fine weight set point is attained. A stirrer is employed for blending the at least first and second component into a solution, and a process tank is provided for receiving the solution and distributing it to the point of use.

BRIEF DESCRIPTION OF THE DRAWINGS

The objects and advantages of the invention will become apparent from the following detailed description of the preferred embodiments thereof in connection with the accompanying drawings, in which.

DETAILED DESCRIPTION OF THE PREFERRED EMBODIMENTS OF THE INVENTION

Figure 1:
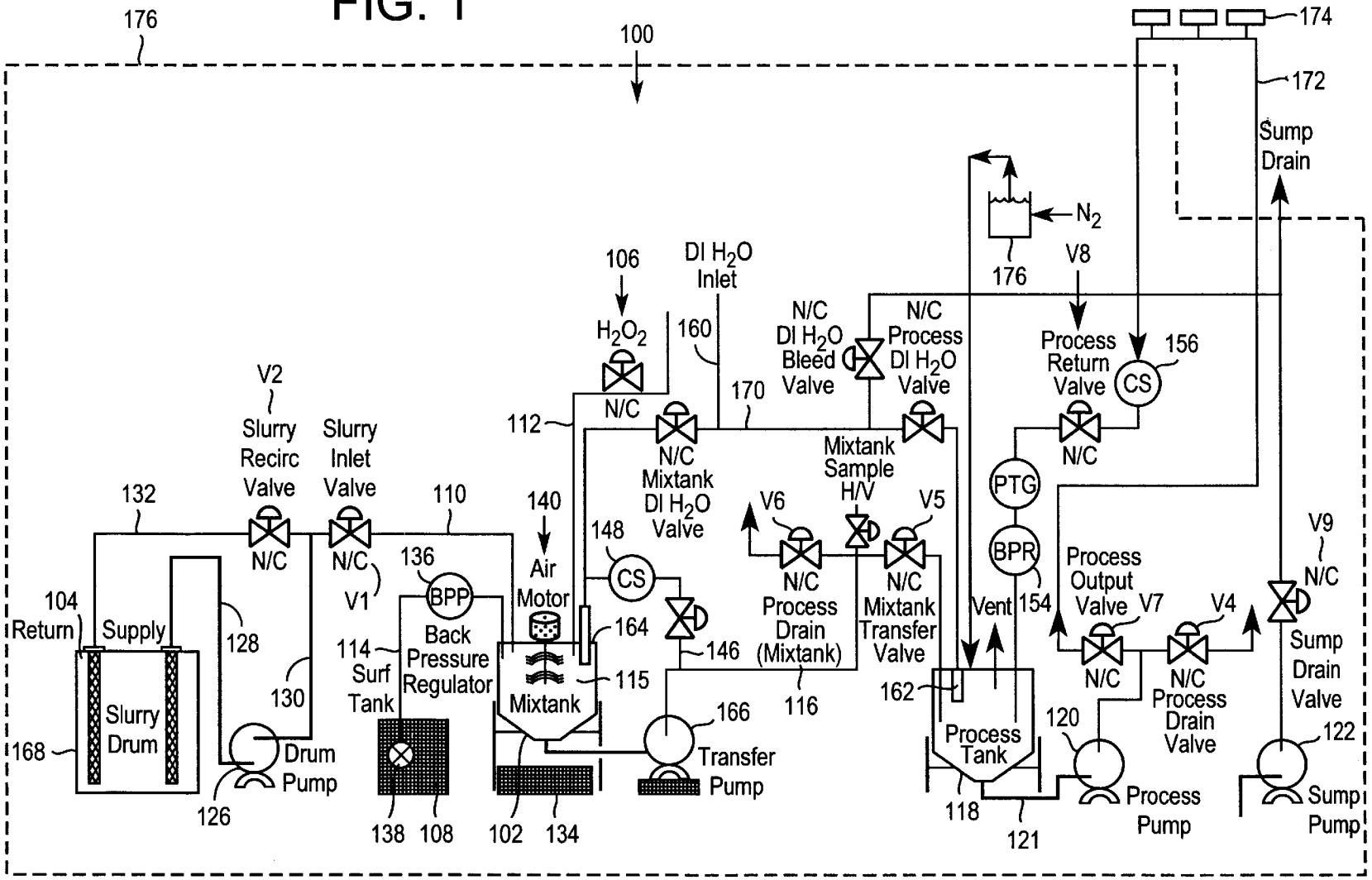
FIG. 1 is a schematic diagram of an exemplary slurry blender and distribution system in accordance with the invention.

FIG. 1 illustrates a schematic diagram of an exemplary slurry blender and distribution system connected to a point of use in a semiconductor manufacturing facility. It should be clear that the inventive concepts described below are in no way limited to the preferred embodiment, and can readily be applied to other blender and distribution system configurations and process schemes.

The blender and distribution system 100 includes a mixing/blending tank 102, wherein components making up the slurry are provided thereto via conduits 110, 112 and 114. The components are added sequentially in amounts to obtain a predetermined slurry composition as described below.

In a preferred embodiment, an oxide abrasive slurry material is supplied from a drum 168 through conduits 128 and 130 and is transported through the system by slurry pump 126. When not being introduced into the blending tank 102, the slurry is recirculated to drum 168 via conduits 128, 130 and 132 to maintain the material in a suspended state. While recirculating the slurry material, slurry inlet valve $V_1$ is closed and recirculation valve $V_2$ is opened. It will be readily recognized by those skilled in the art that valves $V_1$ and $V_2$, as well as the other valves and control devices in the system, automatically operated by a suitable control system.

Figure 2A:
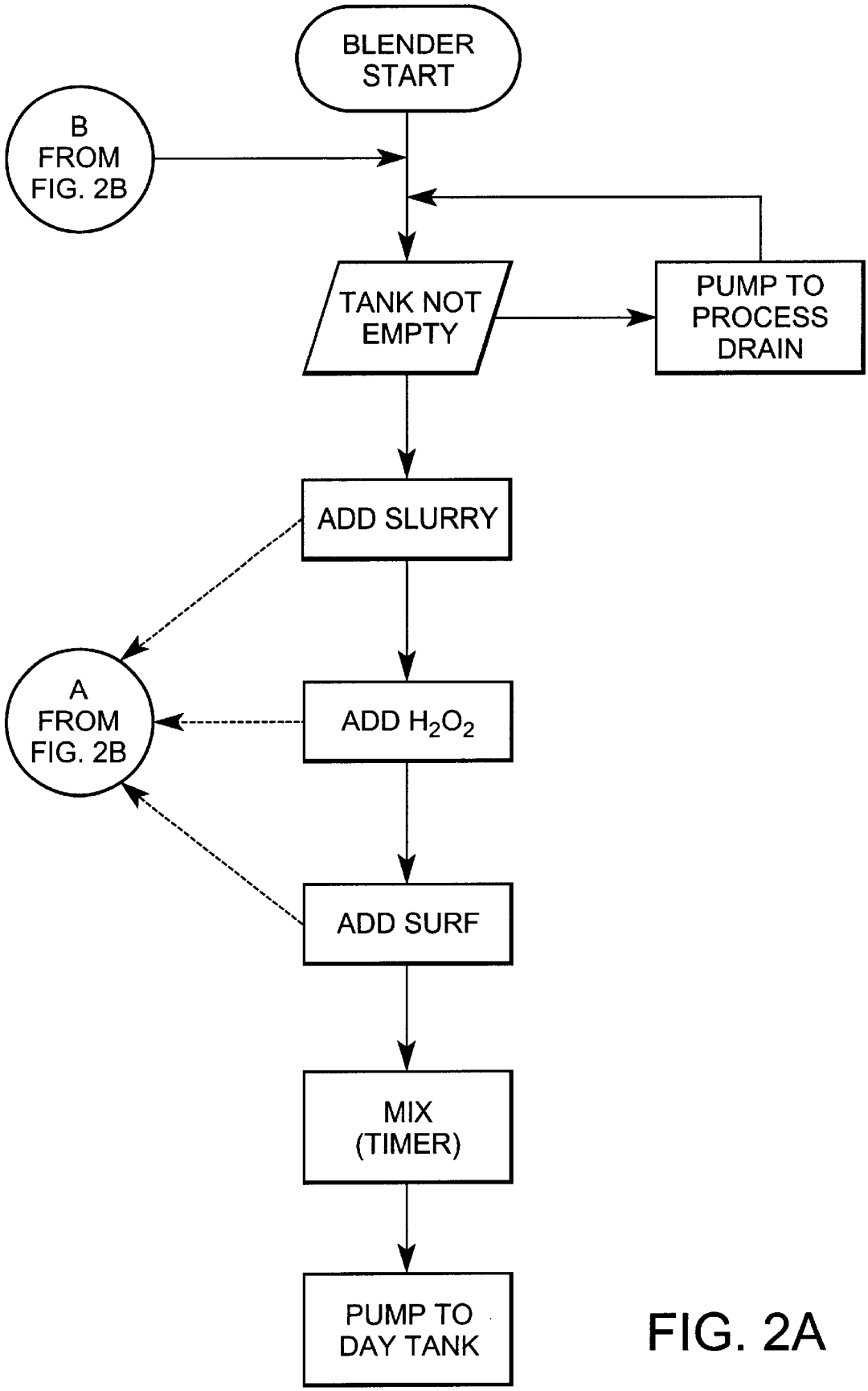
FIGS. 2A–2C are flow charts illustrating an exemplary process.

With reference to both FIG. 1 and FIG. 2A, the components of the slurry solution are added in specific proportions to arrive at the desired slurry composition. In doing so, each component is introduced into the blending tank 102 sequentially until the requisite amount of each component has been added.

Blending tank 102 is disposed on a scale 134, which allows measurement of the contents of the blending tank, and thus the weight of each incoming component. A suitable controller such as a programmable logic controller (PLC), a microprocessor type or other known controller (not shown) adjusts and controls the amount of each material provided.

In accordance with the exemplary embodiment, the weight of the blending tank 102 is measured to ensure that the tank is empty. In the event material is present in the blending tank 102, the transfer pump 166 is activated and the contents are removed therefrom. Alternatively, the slurry can be transferred through the system and to a point of use by employing pressurized ultra-pure nitrogen or any other inert gas. A pressurized nitrogen delivery system is described in U.S. Pat. No. 4,390,126 to Bucholz et al and Patent Abstract of Japan, Vol. 6 No. 127, Mar. 30, 1982, which are hereby incorporated by reference in their entirety.

The order of adding the components in the exemplary embodiment is the slurry, the hydrogen peroxide and finally the surfactant. When the scale or level sensors detect that the mixing tank is empty, valve $V_2$ is closed and valve $V_1$ is opened. The slurry is thereby introduced into the blending tank 102 via conduits 128 and 130. The preset weight entered in the programmable logic controller directs the amount of material necessary to be added.

After adding the slurry and hydrogen peroxide to the blending tank 102, a third component, namely a surfactant, is added to the blending tank 102. The surfactant is contained in a surfactant tank 138, and is introduced into blending tank 102 via conduit 114. A back pressure regulator 136, disposed in conduit 114, assists an injector 138 to dose finite amounts of surfactant into the blending tank. Regulator 136 prevents air bubbles to travel through conduit 114 in between the injection pulses and maintains the pressure between injector 138 and regulator 136 approximately constant. Thus, the amount of surfactant dispensed with each injection pulse is substantially the same.

Figure 2B:
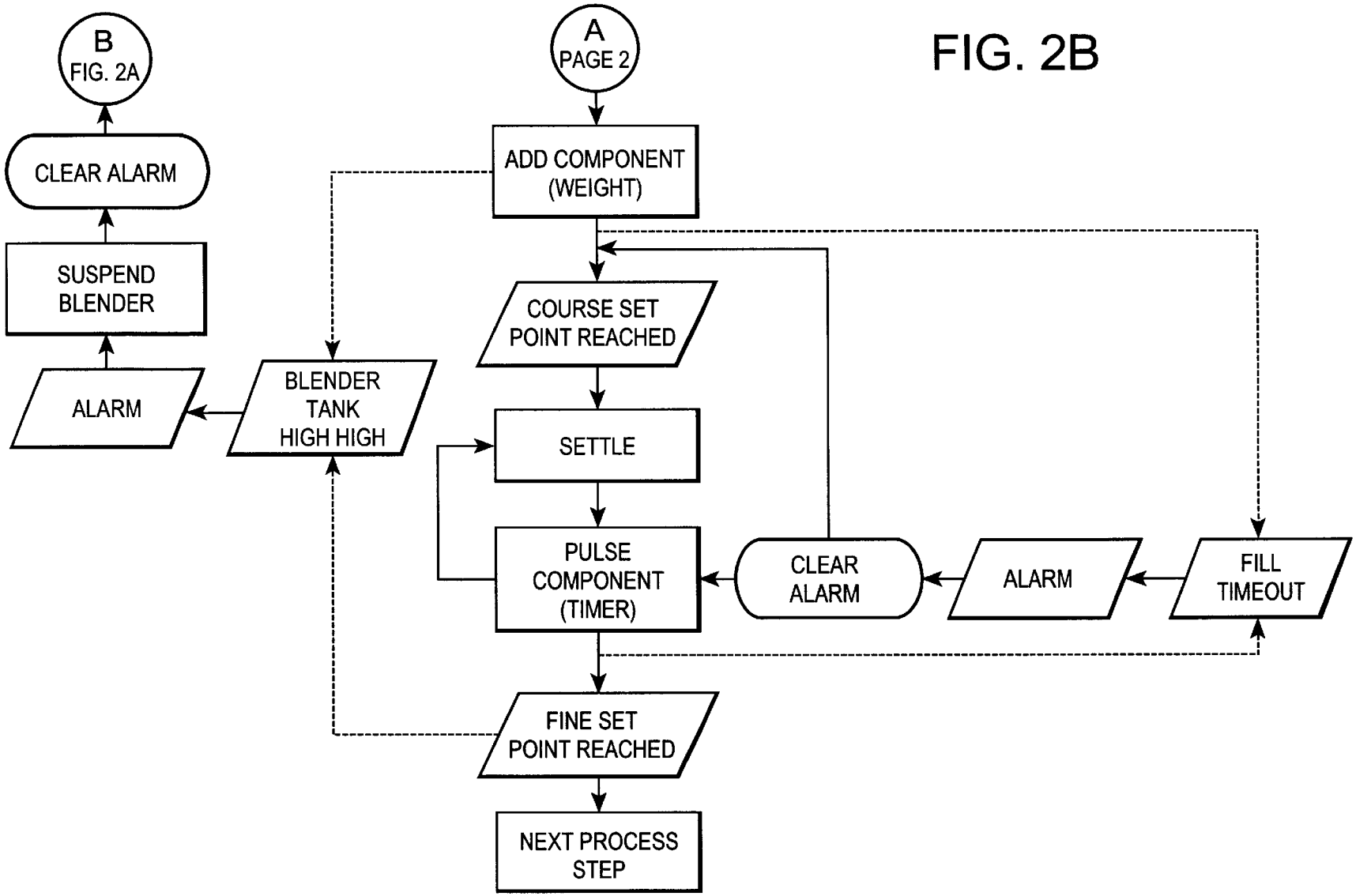

As illustrated in the flow diagram of FIG. 2B, the component is introduced into the blending tank and weighed until a coarse weight set point in the blending tank 102 is reached. Once this point is reached, the material is allowed to settle for a predetermined amount of time, and injected therein. The injection is controlled by the duration of valves being open or closed. The timers operating the valves depend on the process. For example, surfactant can be added by weight or by injection. As the desired weight of the slurry is obtained, the scale is reset to a zero reading and the following component is added. Of course, the subsequent components may simply be added until the combined weight of the components is reached.

A timer can be employed to ensure that the component adding process is working properly. The timer is set to a predetermined period of time for supplying the component. In the event the component is not provided to the mix tank during the specified period of time, the system goes to fill timeout (i.e., the system stops), wherein an alarm is activated and the operator is notified. The operator may subsequently change the empty supply drum, open the valve associated with the particular component drum or otherwise fix the problem within the system. The alarm is then cleared and the component added until the coarse set point is reached.

Thereafter, the component is allowed to settle in the mix tank for a predetermined period of time and the material is pulse-injected in the mix tank until a fine weight set point is reached. As described above, with reference to the coarse weight set point, the timer is employed to monitor the addition of the pulsed component. In case the fine weight set point is not reached within a predetermined period of time the system goes to fill timeout, wherein the operator is notified by an alarm that the component is not provided due to a malfunction in the system. Accordingly, the operator is afforded an opportunity to correct the problem and the component is pulse-injected into the mix tank until the fine weight set point is attained.

Mix tank 102 includes a variable sensor tree as the one described in U.S. application Ser. No. 09/168,607, now U.S. Pat. No. 6,305,235 assigned to L'Air Liquide, and incorporated herein by reference in its entirety. The sensors are placed to detect the high and low level of formulation in the mix tank. Additionally, a redundant sensor is disposed thereon for each high and low level sensor. These sensors provide a contingent part of the system in case there is a process malfunction (i.e., a system valve remains affixed in the open position) while adding one of the components. The solution in blender/mix tank 102 is detected by the redundant high level sensor, thereby triggering an alarm. The blender/mix tank operation is immediately suspended until the problem is fixed and the alarm is cleared.

Thereafter, as shown with reference to FIG. 2A, if there is any residual solution in blender/mix tank 102 as detected by the low level sensors, the solution is directed to drain. It is assumed that the error causing the overfill of the tank has compromised the solution within.

After confirming that the tank is empty, a new batch of oxide abrasive solution is prepared in the manner described above with reference to FIG. 2A, wherein hydrogen peroxide and surfactant are added sequentially to the abrasive oxide. Accordingly, the integrity of the following batch is assured. The slurry in process tank 118 is maintained under a blanket of moisturized nitrogen, or any other moisturized inert gas to prevent a caking phenomenon, where the slurry sticks to walls of process tank 118. While not wishing to be limited to any particular theory explaining this phenomenon, caking may occur due to the agglomeration of the particles suspended in the aqueous slurry solution as the solution dries.

An ultra-pure nitrogen stream is passed through a tank 176 containing deionized water to moisturize the gas. The moisturized nitrogen gas stream is subsequently conveyed to process tank 118, so as to form a blanket over the slurry therein.

Upon reaching the requisite combined weight of the materials in mix tank 102, as provided to the program logic controller, the solution is blended via a helical or vortex stirrer 115 actuated by an air motor 140 or the like to arrive at the desired homogeneous batch of certain concentration.

The mixed solution is conveyed by a transfer pump 166 through conduits 116 to a process tank 118 based on the level of solution in process tank 118. This tank is commonly known in the industry as a "day tank." The normally closed mix tank transfer valve is opened and the solution is delivered to process tank 118. Alternatively, if the solution has been contaminated, or in any way compromised by external influences, the solution is delivered to drain. Accordingly, the normally closed mix tank transfer valve $V_5$ remains closed and the normally closed process drain valve $V_6$ is opened in order to convey the solution to drain.

The concentration of the solution entering process tank 118 may be measured by placing a concentration sensor 148 on conduit 116 or alternatively on conduit 146 which branches from conduit 116 and returns to mix tank 102. In this manner, the solution concentration is measured and simultaneously recirculated back to mix tank 102. Therein, the concentration can be adjusted to attain the desired value by injecting the components, as described above.

In the preferred embodiment, the concentration of hydrogen peroxide in the oxide abrasive slurry formulation is measured by a concentration sensor 148. Suitable concentration sensors include, for example, electrodeless conductivity sensors employing AC Torroid coils for ionic solutions, such as those containing hydrogen peroxide, and acoustic signature sensors for non-ionic solutions.

The slurry solution is introduced into process tank 118 until the high level sensor detects the solution therein. Sensor trees, such as the ones discussed with reference to mix tank 102, are utilized with the process tank, wherein the sensors mounted on the tree detect the solution in tank 118.

Figure 2C:
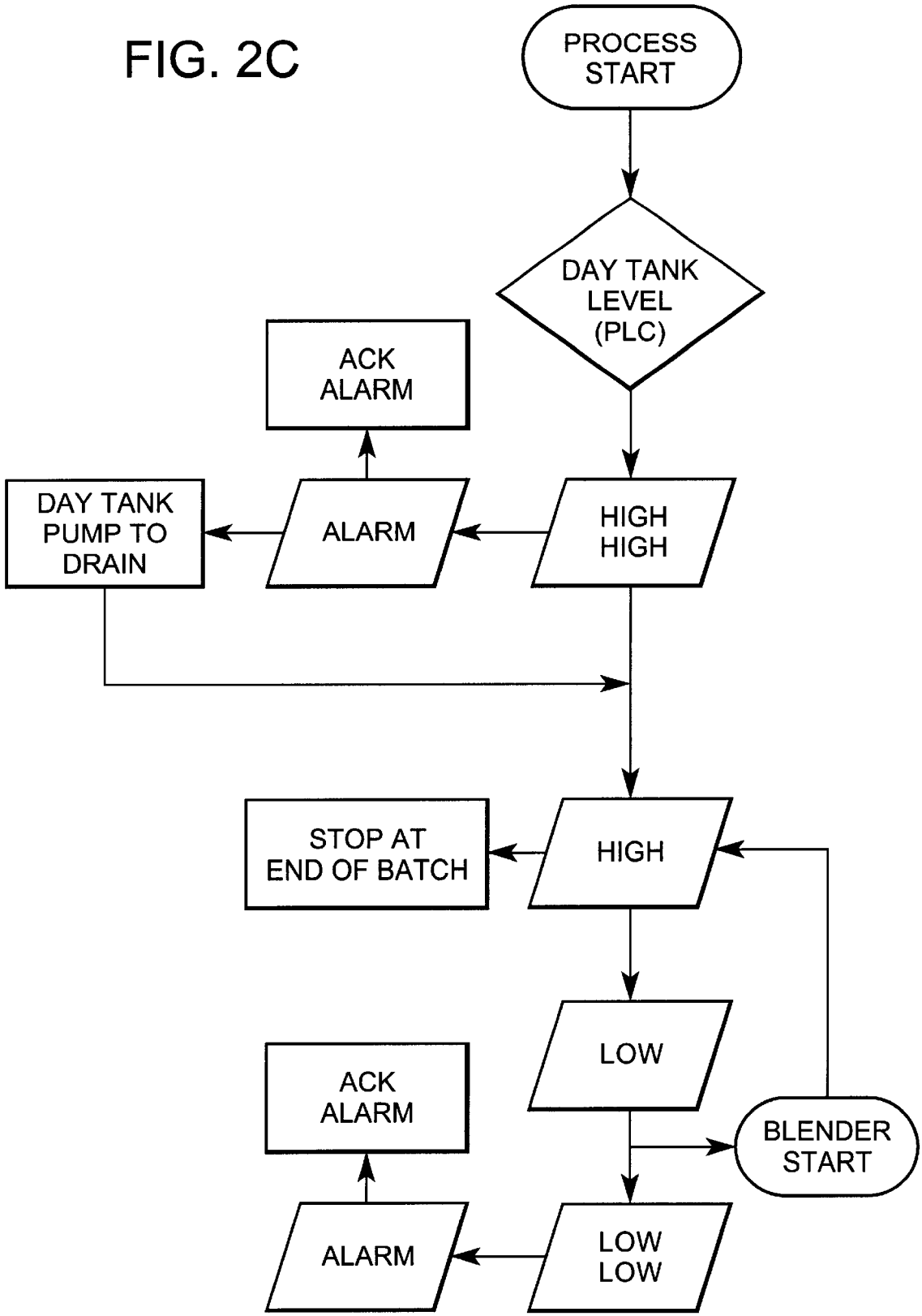

FIG. 2C, is a flow chart illustrating the procedure for operation of the process/day tank 118.

The level of slurry solution in the day tank is monitored by the controller based on the reading of the sensors. The normally closed process output valve $V_7$ is opened when the distribution sensor (not shown) is enabled and process pump 120 disposed downstream of tank 118 conveys the solution through a conduit 172, commonly known to those skilled in the art as a Winkleman loop. The solution is recirculated in the loop to the point of use where part of the solution is drawn off at work stations 174 and returned back to process tank 118 through return valve $V_8$.

The hydrogen peroxide component of the slurry employed in the preferred embodiment is known to decompose with time. Accordingly, a concentration sensor 156 may optionally be employed in the Winkelman loop to monitor the concentration of this component in the slurry solution to ensure that it is maintained within specification limits.

Back pressure regulator 154 maintains a desired pressure to recirculate the solution in the Winkelman loop. Should the pressure rise to a level above the one set by the operator, the formulation bypasses the regulator and flows into process tank 118 until the set pressure is arrived at. On the other hand, should the pressure drop below the set level, regulator 154 is adjusted until the desired pressure level on the loop is achieved. Thus, the pump may be adjusted or repaired. Meanwhile, an alarm is sounded or displayed.

In the event the high level sensor malfunctions, the solution continues to be supplied to day tank 118 until the redundant high level sensor is reached. At that point an alarm is sounded to notify the operator, who can acknowledge the alarm from the controller. Simultaneously, the normally closed process drain valve $V_4$ is opened to deliver the solution to drain. Upon reaching a satisfactory condition, where the level of solution has receded below the high level redundant sensor, process drain valve $V_4$ is closed and the slurry is continuously supplied to the process tool.

As the slurry solution is drawn off, the amount of slurry in the day tank decreases below the low level sensor, at which point the blender/mix tank 102 is activated by the controller to begin forming and supplying a new slurry solution batch. At this juncture, the programmable logic controller activates the mixing tank to begin adding the components supplied to process/day tank 118, as described above.

The slurry solution is subsequently supplied to process/day tank 118 until the high level sensor detects that the tank has been filled and stops delivery thereto. However, should the slurry solution in day tank 118 decrease beyond the level of redundant low level sensor, an alarm on the controller is sounded to inform the operator that the blender/mix tank is not providing the requisite slurry. As a result, the operator is afforded the opportunity to investigate and rectify the problem.

In the event the batch prepared and transferred to process tank 118 has been contaminated or is not up to specification for the particular application, the process tank may be purged. Process tank 118 is emptied by opening the normally closed process drain valve $V_4$ and the batch solution is conveyed to drain. After draining, the process tank 118 is preferably cleared with deionized water.

Valve $V_3$ is opened and deionized water is introduced through conduit 160, 170 into process tank 118, preferably via an omnidirectional spray head 162 to rinse the inner surfaces of sides of the process tank 118. When the deionized water reaches the high level sensor, the process pump 120 is turned on and process drain valve $V_4$ is opened. The wash water in the process tank is thus sent to drain.

Optionally, process valve $V_7$ may be opened and the deionized water allowed to pass through the Winkleman loop 172, thereby purging it. After passing the water through the loop, it is returned to process tank 118 through conduit and is further passed to drain by process pump 120.

The blending tank 102 can be cleared in a similar manner. Deionized water may be introduced into blending tank 102 via conduit 160, preferably through omnidirectional spray head 164, to cleanse the blending tank 102 in preparation for the following slurry batch. As spray head 164 introduces deionized water into the tank, mix transfer $V_5$ is closed and the normally closed process drain valve $V_6$ is opened to deliver the water to drain.

The system 100 can be encased in a cabinet type enclosure (shown by dashed lines) to protect the system from outside influences. A sump pump 122 can be provided at the bottom of the cabinet to remove any liquid which escapes from the system. One or more liquid level sensors or proximity switches are disposed in a sump of the cabinet, to detect leakage from the system, whether it be from the conduits, the chemical suppliers, the tanks or any other part of the system. Upon detection of liquid in the bottom of the cabinet by a sensor (not shown), sump pump 122 is activated, and the normally closed sump drain valve $V_9$ is opened, and the alarm sounded or displayed, thereby allowing the liquid to be pumped to the sump drain. Accordingly, the operator may intervene and take the necessary action to restore the process to working conditions.

While the invention has been described in detail with reference to specific embodiments thereof, it will be apparent to those skilled in the art that various changes and modifications can be made, and equivalents employed, without departing from the scope of the appended claims.

What is claimed is:

1. A process for blending and conveying a slurry solution to a point of use in a semiconductor processing facility, comprising:

supplying at least a first and a second component to a mix tank sequentially, adding each said component until a coarse weight set point is reached and, upon attaining said coarse point, said component is allowed to settle and further added via pulsed injection until a fine weight set point is attained, thereafter blending the components into a slurry solution and conveying said slurry solution to a process tank and henceforth to the point of use.

2. The process according to claim 1, further comprising:

adding said components by weight, wherein a scale is disposed below said mix tank to measure the weight of each incoming component.

3. The process according to claim 2, further comprising:

adding at least one of said components into said mix tank based on either weight or by injecting a timed shot.

4. The process according to claim 2, wherein said first component is a slurry and said second component is a hydrogen peroxide.

5. The process according to claim 4, further comprising a third component, wherein said third component is a surfactant.

6. The process according to claim 1, wherein said components are blended by an agitator in the mix tank to form said slurry solution and is further conveyed to said process tank.

7. The process according to claim 6, wherein said blending is performed by a shaft and blade system driven by a motor for a predetermined period of time.

8. The process according to claim 7, further comprising:

employing a transfer pump to convey said slurry solution from said mix tank to said process tank.

9. The process according to claim 8, wherein said process tank delivers said slurry solution via a process pump to the point of use through a Winkelman loop, and wherein said loop recycles an unused portion of said slurry solution back to said processing tank.

10. The process according to claim 9, wherein upon falling below a predetermined minimum level of said slurry solution in said process tank a signal is sent to said mix tank to start blending the components in order to supply said slurry solution to said process tank.

11. The process according to claim 10, wherein upon surpassing a predetermined maximum level of said slurry solution in said process tank an alarm is activated to alert an operator and a process valve drain is opened to drain an excess portion of said slurry solution.

12. The process according to claim 8, wherein said process tank delivers said slurry solution via a pressurized nitrogen delivery system to the point of use through a Winkelman loop, and wherein said loop recycles an unused portion of said slurry back to said processing tank.

13. The process according to claim 12, further comprising a controller to monitor and control all functions of said process.

14. The process according to claim 13, further comprising a containment sump, wherein said containment sump includes a leak sensor to sense any malfunction in said process and upon sensing said malfunction transmits a signal to said controller to shut down the process.

15. The process according to claim 7, further comprising:

employing a pressurized nitrogen delivery system to convey said slurry solution from said mix tank to said process tank.

16. The process according to claim 1, further comprising:

introducing a moisturized gas into said process tank to form a blanket above the slurry solution.

17. The process according to claim 1, wherein deionized water is introduced into said mix tank and said process tank to flush said tanks clean between production runs.

18. A system for blending and conveying a slurry solution to a point of use in a semiconductor facility, comprising:

a mix tank wherein at least a first and a second component are added sequentially, until each component reaches a coarse weight set point and said component is allowed to settle, there being at least one device for further adding said components via pulsed injection until a fine weight set point is attained;

a stirrer for blending said at least first and second component into a slurry solution;

a process tank for receiving said solution; and a conduit arranged for conveying said solution from said process tank and henceforth to the semiconductor facility point of use.

19. The system according to claim 18, further comprising a controller to monitor and adjust the blending and conveying of said slurry solution to the point of use.

20. The system according to claim 18, wherein a scale is disposed below said mix tank to measure the weight of each incoming component.

21. The system according to claim 18, further comprising another conduit, wherein said first component is a slurry supplied from a drum via said another conduit.

22. The system according to claim 21, wherein a pump is disposed on said another conduit to transfer the slurry component to said mix tank.

23. The system according to claim 22, wherein a valve is disposed on said another conduit downstream of said pump.

24. The system according to claim 18, wherein a third component comprising surfactant is supplied to said mix tank.

25. The system according to claim 24, wherein said system includes an injector employed to deliver said third component to said mix tank.

26. The system according to claim 18, further comprising another conduit, said another conduit having a pump disposed thereon, wherein said mixed slurry solution is transferred from said mix tank to said process tank via said another conduit.

27. The system according to claim 26, further comprising at least two valves disposed downstream of said pump.

28. The system according to claim 26, wherein one of said valves allows said slurry solution to be delivered to said process tank.

29. The system according to claim 26, wherein one of said valves allows said slurry solution to be delivered to drain.

30. The system according to claim 18, further comprising another conduit, said another conduit having a pressurized nitrogen delivery system disposed thereon, wherein said mixed slurry solution is transferred from said mix tank to a process tank via said another conduit.

31. The system according to claim 18, wherein said conduit is adapted to return unused solution to said mix tank.

32. The system according to claim 31, further comprising a pump disposed on said conduit to deliver said slurry solution to the point of use.

33. The system according to claim 31, further comprising a pressurized nitrogen delivery system connected to said conduit to deliver said slurry solution to the point of use.

34. The system according to claim 31, further comprising at least two valves disposed downstream of said pump.

35. The system according to claim 34, wherein one of said valves allows said slurry solution to be delivered to drain.

36. The system according to claim 31, further comprising a concentration sensor disposed on said conduit upstream of a point of return of said unused slurry solution to said process tank.

37. The system according to claim 31, further comprising a back pressure regulator to maintain a desired pressure in said conduit.

38. The system according to claim 18, wherein said system is contained within a cabinet.

39. The system according to claim 38, wherein said cabinet includes a capacitive proximity switch in a sump of said cabinet to detect any leaks.

40. The system according to claim 18, further comprising another conduit, wherein said mix tank and said process tank are purged via said another conduit introducing de-ionized water into said tanks.

41. A process for blending and conveying a slurry solution to a point of use in a semiconductor processing facility, comprising the steps of:

supplying a first portion of a first component to a mix tank until a coarse weight set point of the first component is achieved within the mix tank;

supplying by pulse injection a second portion of the first component to the mix tank until a fine weight set point of the first component is achieved within the mix tank;

supplying a first portion of a second component to the mix tank until a coarse weight set point of the second component is achieved within the mix tank;

supplying by pulse injection a second portion of the second component to the mix tank until a fine weight set point of the second component is achieved in the mix tank;

blending the supplied first and second components within the mix tank; and conveying the blended first and second components to a process tank and thereafter to the semiconductor processing facility point of use.

* * * * *

UNITED STATES PATENT AND TRADEMARK OFFICE

CERTIFICATE OF CORRECTION

PATENT NO. : 6,554,467 B2 
DATED : April 29, 2003
INVENTOR(S) : David Snyder, Karl Urquhart and Richard Swindell It is certified that error appears in the above-identified patent and that said Letters Patent is hereby corrected as shown below:

Column 8,
Line 6, please delete the number "10" and insert the number -- 9 --.

Signed and Sealed this

Twenty-sixth Day of August, 2003

JAMES E. ROGAN
*Director of the United States Patent and Trademark Office*